United States Patent [19]

Cover

[11] Patent Number: 4,723,533

[45] Date of Patent: Feb. 9, 1988

[54] COMBUSTION AIR VENT WITH AUTOMATIC LOCK

[76] Inventor: Theodore L. Cover, 6161 Clovergreen Pl., St. Louis, Mo. 63129

[21] Appl. No.: 884,191

[22] Filed: Jul. 10, 1986

[51] Int. Cl.[4] ..... F24B 1/18

[52] U.S. Cl. ..... 126/120; 98/119; 126/143; 126/285 R; 237/51; 237/46

[58] Field of Search ..... 126/120, 121, 143, 288, 126/285 R, 290, 122, 112, 295, 85 B; 251/65; 237/46, 47, 48, 51, 53, 50; 236/45, 49, 1 G; 98/37, 119, 33 R

[56] References Cited

U.S. PATENT DOCUMENTS

| | | | |
|---|---|---|---|
| 2,251,916 | 1/1918 | Parsons | 237/51 |
| 3,250,206 | 5/1966 | Strouth | 98/119 |
| 3,541,945 | 11/1970 | Wexler | 98/119 |
| 4,231,516 | 11/1980 | Weingartner | 237/51 |
| 4,498,624 | 2/1985 | Kogut | 126/112 |

FOREIGN PATENT DOCUMENTS

| | | | |
|---|---|---|---|
| 3030130 | 3/1982 | Fed. Rep. of Germany | 236/45 |
| 161214 | 8/1985 | Japan | 237/46 |

*Primary Examiner*—James C. Yeung

*Attorney, Agent, or Firm*—Rogers, Howell, Moore & Haferkamp

[57] ABSTRACT

An air vent for supplying air for combustion to a fireplace or the like inside a building, the vent comprising a duct having an inlet end outside the building and an outlet end inside the building, a cover hingedly mounted over the outlet and pivoting between an open position and a closed position covering the outlet, the cover being sufficiently light that a pressure differential caused by combustion inside the building maintains the cover open. A tab, having a portion of hook-and-loop type fastening material, depends from the cover and a patch of mating hook-and-loop type fastening material is positioned adjacent the outlet end to engage the tab. The cover is sufficiently heavy that when the pressure differential drops the cover falls with sufficient force to engage the tab and patch, locking the cover closed.

3 Claims, 6 Drawing Figures

COMBUSTION AIR VENT WITH AUTOMATIC LOCK

BACKGROUND AND SUMMARY OF THE INVENTION

This invention relates to an air vent for supplying outside air for combustion to a heater, and in particular to an air vent that automatically locks after air is no longer required to prevent the intrusion of cold air.

It is now recognized that with any heater generating heat through combustion, such as a furnace or fireplace, it is desirable to draw the combustion air from the outside, rather than using the already heated inside air. In addition to wasting heated air, using the internal air lowers the pressure inside the building causing the cold external air to be drawn inside through gaps around doors and windows.

Thus, numerous devices have been made to supply external combustion air to fireplaces or furnaces. For example, Bolinger, U.S. Pat. No. 2,409,731, discloses a fireplace having an air supply duct with a manually operated door. Dyer, U.S. Pat. No. 3,805,764, discloses a heating system with exterior air inlet for combustion chamber. The system includes a tube extending from the exterior of the building to the combustion chamber of the furnace. Wilhoite, U.S. Pat. No. 4,108,144, discloses a supplemental air supply for a fireplace. The device includes manifolds on either side of the fireplace opening to supply air to the fireplace through manually adjusted outlets. The manifolds are connected to pipes to provide outside air for combustion. Grott, U.S. Pat. No. 4,121,562, discloses an energy conservation kit for household furnaces. The kit includes an air duct for connecting the furnace to the exterior. The duct contains a flapper valve to insure that air only travels inwardly. Kellogg (deceased) et al., U.S. Pat. No. 4,195,618, discloses a fireplace venting system. The device comprises a plurality of holes about the periphery of the fireplace opening to supply combustion air. The holes are connected to a conduit or duct which is connected to an inlet. A damper is formed in each conduit to manually close it when the fireplace is not in use. Berg, U.S. Pat. No. 4,156,418, discloses an air intake system for an enclosed freestanding fireplace. The device has a conduit for the introduction of outside air into a closed fireplace. Bellaff, U.S. Pat. No. 4,285,325, discloses a balancing air device for a heating unit. The device comprises an air line for providing combustion air to a furnace. The air line has a bypass for venting excess air, and can be provided with a manually operated damper. Kogut, U.S. Pat. No. 4,498,624, discloses a control unit with separate dampers for make up and combustion air circulation. The control unit has two separate inlets, each inlet responsive to a pressure differential to operate both dampers.

With any combustion heater, and especially with fireplaces which usually open into the occupied rooms of a building, it is important to close the air supply after the fire is out to prevent cold outside air from entering. However, few of the prior art combustion air supply devices had any means to close the air supply, and those that did had to be manually operated. Often by the time the fire has died out, the users have left the room or would simply forget to close the air supply. The open air supply would allow cold air to infiltrate the room. What was needed was a simple, inexpensive device that could supply combustion air but which would automatically close and lock when the influx of combustion air was no longer needed.

Applicant has solved this need by providing an elegantly simple, inexpensive control device for a combustion air vent. The device is particularly well suited for fireplaces. The vent, a simple air duct, is preferably installed adjacent the fireplace hearth, near the floor, and extends through the wall to the exterior of the building. The exterior end of the conduit is preferably provided with a cowling to shield the opening. Various screens and/or filters can be provided over the inlet to block the passage of debris or small animals.

The outlet opening preferably also has a cowling to shield the opening and to channel the exiting air downwardly. Within this cowling, a cover is positioned over the outlet and hingedly secured at the top. Depending from the bottom of the cover is a tab of hook-and-loop type fastening material. Immediately below the outlet, in position to contact the tab on the cover, is a mating patch of hook-and-loop type fastening material.

The cover is weighted such that it is sufficiently light that the pressure differential caused by the combustion in the fireplace keeps the cover at least partially open so that air can be drawn in from the outside for combustion. However, the cover is sufficiently heavy so that when the fire dies and eliminates the pressure differential, the impact of the closing flap gate is sufficient to engage the tab and patch of mating hook-and-loop type fastening material to lock the cover in the closed position. The cover can also be manually locked in the closed position by position by pressing the tab and patch together. A second patch of hook-and-loop type fastening material can be provided on the inside of the cowling so that the cover can be locked in the open position.

When a fire is started, the cover is quickly and easily opened by pulling the tab on the cover free. The cover can either be locked in the open position or left unattached so that the pressure differential can maintain the cover at least partially open. When the fire dies down, the pressure differential diminishes and the cover falls shut, the impact locking the cover in the closed position.

The device of this invention is elegantly simple, inexpensive, and easy to install. It provides an easily controllable supply of combustion air for a fireplace or the like. The device automatically closes and locks when no more combustion air is needed. The device can also be manually locked in either the open or closed positions.

DETAILED DESCRIPTION OF THE PREFERRED EMBODIMENT

A combustion air vent with automatic lock constructed according to the principles of this invention, indicated generally as 20, is shown as it would be installed in a wall 22 adjacent hearth 24 of fireplace 26. In practice, the device has been installed as much as four feet from the stove or fireplace and has worked satisfactorily. This allows the device to be placed away from the masonry around the fireplace 26, for easier installation.

Figure 2:
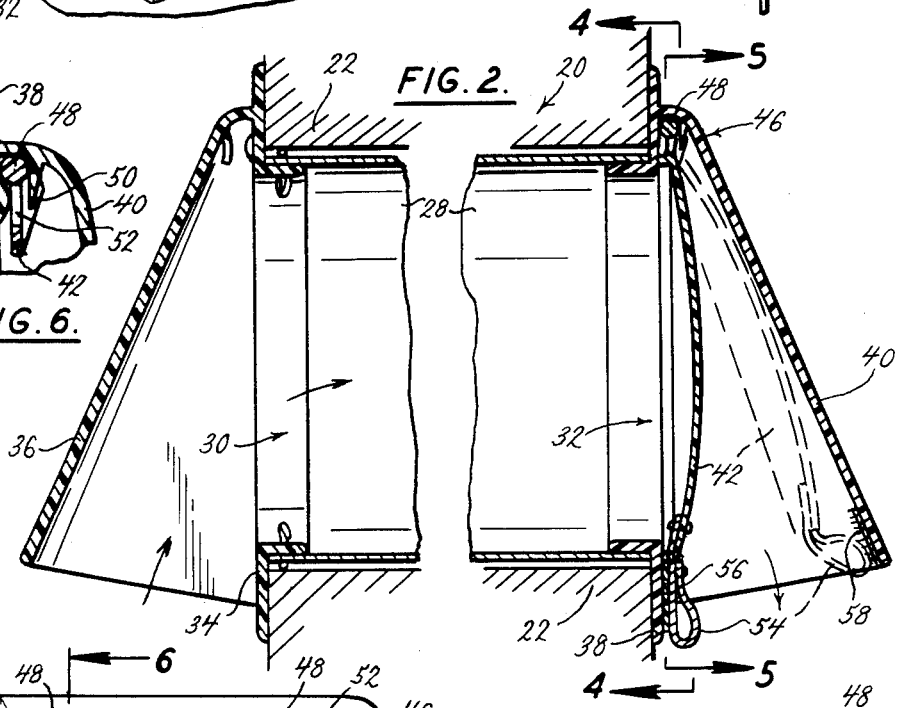
FIG. 2 is a cross-sectional view of the air vent taken along the plane of line 2—2 in FIG. 1.
Figure 4:
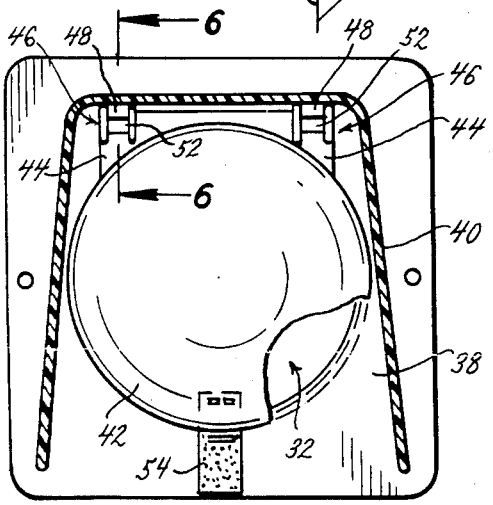
FIG. 4 is cross-sectional view of the outlet end of the air vent taken along the plane of line 4—4 in FIG. 2.
Figure 5:
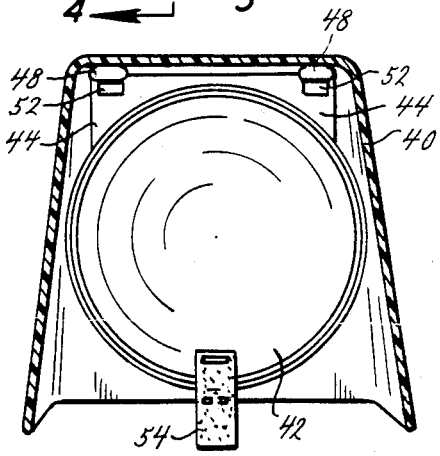
FIG. 5 is a cross-sectional view of the outlet end of the air vent taken along the plane line 5—5 in FIG. 2.

As best shown in FIG. 2, air vent 20 comprises air duct 28, which in the preferred embodiment has a circular cross-section. Duct 28 extends through wall 22 with an inlet end 30 outside the building and an outlet end 32 inside the building. The inlet end 30 of duct 28 is covered with an end cap 34 having a cowling 36 that shields inlet 30 but allows air to enter. Cap 34 is preferably made of a low heat conductive material, such as plastic. This minimizes the heat conducted from inside the building and helps to prevent the build-up of frost or condensation in the cap 34. Duct 28 may also be of a low heat conductive material. A screen and/or filter (not shown) can be mounted over the inlet 30 to prevent small animals and debris from entering the building.

Figure 1:
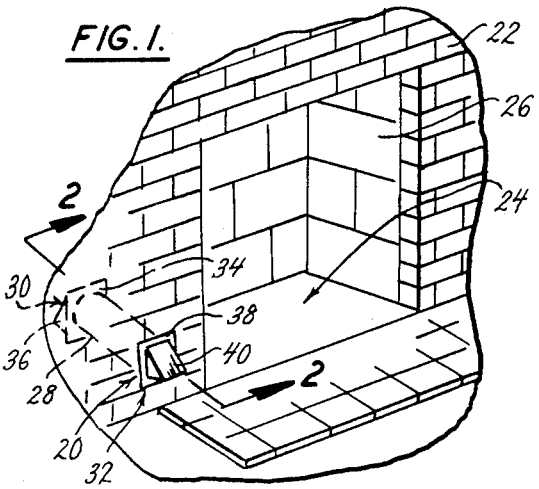
FIG. 1 is an orthogonal view of an air vent with automatic lock constructed according to the principles of this invention as it would be installed adjacent a fireplace.
Figure 3:
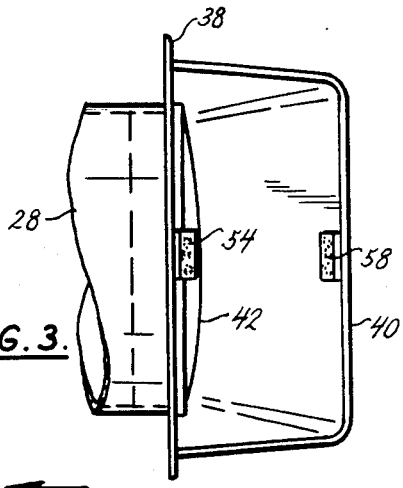
FIG. 3 is a bottom view of the outlet end of the air vent.
Figure 6:
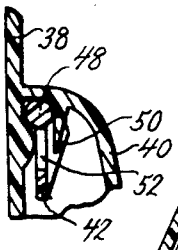
FIG. 6 is a partial cross-sectional view of the outlet end of the air vent, showing the hinged mounting of the cover, taken along the plane of line 6—6 in FIG. 4.

The outlet end 32 of duct 28 is covered with an end cap 38 having a cowling 40 to mask the opening and to deflect exiting air downwardly as indicated by the arrows in FIG. 2. Cap 38, like cap 34, is preferably made of a low heat conductive material. A cover 42 is pivotally mounted in cap 38, behind cowling 40, over outlet 32. Cover 42 has a generally circular shape to cover outlet 32, but has ears 44 extending from its top edge. Cover 42 is pivotally mounted along its top edge with hinges 46. As best shown in FIG. 6, each hinge 46 can include an enlarged section 48 on the top edge of cover 42 that is trapped in a clip 50 formed in cap 38. A cutout 52 below each hinge 46 allows cover 42 to pivot freely outwardly without interference from clips 50. Cover 42 is normally in the closed position, covering outlet 32.

A tab 54 depends from the bottom edge of cover 42. Tab 54 is made from or has a portion of hook-and-loop type fastening material, such as Velcro (TM). A first patch 56 of mating hook-and-loop type fastening material is mounted on cap 38, below outlet 32, in position to engage tab 54 on cover 42 when it is closed. A second patch 58 of mating hook-and-loop type fastening material is mounted on the inside side of cowling 40, in position to engage tab 54 on cover 42 when it is wide open.

Cover 42 is sufficiently lightweight that a pressure differential such as that caused by a fire burning in hearth 24 of fireplace 26 is sufficient to keep cover 42 open or partially open. However, cover 42 is sufficiently heavy that when the pressure differential drops after the fire dies, the cover falls closed with sufficient force to engage tab 54 and patch 56 to automatically lock cover 42 in the closed position. Cover 42 is thus secured and prevents the infiltration of cold outside air into the room. Cover 42 can be manually operated to the closed position by pressing tab 54 against patch 56. Cover 42 can also be manually operated to the open position by pressing tab 56 against patch 58.

OPERATION

After a fire is built in hearth 24 of fireplace 26, air vent 20 is opened by pulling tab 54 from patch 56 and pulling cover 42 back. The pressure differential caused by the combustion keeps cover 42 at least partially open. When the fire dies, the pressure differential no longer supports cover 42 and cover 42 drops. The impact is sufficient to engage tab 54 and patch 56, locking cover 42 over outlet 32. However, if the pressure is unsteady, it is possibly 20 manually lock cover 42 open by pressing tab 54 against patch 58. It is also possible to lock cover 42 closed by pressing tab 54 against patch 56.

There are various changes and modifications which may be made to the invention as would be apparent to those skilled in the art. However, these changes or modifications are included in the teaching of the disclosure, and it is intended that the invention be limited only by the scope of the claims appended hereto.

I claim:

1. An air vent for supplying outside air for combustion to a fireplace or the like inside a building, the air vent comprising:

an air duct having an inlet end and an outlet end for installation through the building wall with the inlet end outside the building and the outlet end inside the building to conduct air from the outside into the building;

a cover hingedly mounted along its top edge over the outlet, the cover pivoting between an open position and a closed position covering the outlet end, the cover being sufficiently light that a pressure differential caused by combustion inside the building is sufficient to keep the cover at least partially open;

a tab depending from the cover, the tab having at least a portion of hook-and-loop type fastening material;

a patch of mating hook-and-loop type tastening material adjacent the outlet end, positioned to engage the tab when the cover is closed, the cover being sufficiently heavy that when the pressure differential drops the cover falls closed with sufficient force to engage the hook-and-loop type fastening material on the tab and patch, locking the cover in the closed position.

2. The device of claim 1 further comprising a louvred cowling sloping downwardly and outwardly over the oulet end and the cover.

3. The device of claim 1 further comprising a second patch of mating hook-and-loop type fastening material on the inside of the cowling to engage the tab when the cover is wide open.

* * * * *